US005185555A

United States Patent [19]

Lee

[11] Patent Number: 5,185,555

[45] Date of Patent: Feb. 9, 1993

[54] LAMP WITH DOUBLE SWAGED LEAD

[75] Inventor: Sung M. Lee, Bow, N.H.

[73] Assignee: GTE Products Corporation, Danvers, Mass.

[21] Appl. No.: 694,578

[22] Filed: May 2, 1991

[51] Int. Cl.[5] ..... H01J 17/18; H01K 1/18

[52] U.S. Cl. ..... 313/632; 313/332; 313/579

[58] Field of Search ..... 313/632, 331, 332, 578, 313/579

[56] References Cited

U.S. PATENT DOCUMENTS

| | | | |
|---|---|---|---|
| 4,139,794 | 2/1979 | Malm et al. | 313/579 |
| 4,354,137 | 10/1982 | Martin et al. | 313/579 |
| 4,441,051 | 4/1984 | Thomas | 313/579 |
| 4,490,646 | 12/1984 | Bunk et al. | 313/332 X |

*Primary Examiner*—Sandra L. O'Shea

*Attorney, Agent, or Firm*—William E. Meyer

[57] ABSTRACT

A lamp lead with swaged indentations arranged around the circumference of the lead is disclosed. It has been discovered that the orientation of the locking indentation is significant in making a sound mechanical lock with the press seal of a lamp. By arranging the indentations around the lead, proper orientation of at least one of the indentations is always assured.

16 Claims, 3 Drawing Sheets

A - A'

B - B'

LAMP WITH DOUBLE SWAGED LEAD

TECHNICAL FIELD

The invention relates to electric lamps and particularly to lamps having pressed seals. More particularly the invention is concerned with a press sealed electric lamp having a sweged lead captured in the press seal.

BACKGROUND ART

Electric lamps are commonly formed by enclosing the filament in a glass volume and sealing the envelope to the filament leads. The seal between the leads and the envelope is a persistent problem for lamp manufacturers. The envelope usually has a different coefficient of thermal expansion than that of the lead material. When the lamp is turned on, the envelope and lead material heat up, causing mechanical stress between the envelope and the lead. If the lamp is operated at moderate temperatures, a glass material may be used for the envelope, and glasses may be compositionally tuned to have agreeable thermal expansions. Lamps operated at moderate temperatures; however, do not produced high quality light, and are not generally electrically efficient.

If the lamp is designed to be operated at high temperature, the choices for envelope glasses is limited. Quartz may also be selected as a high temperature envelope material. Quartz has a low thermal expansion, so to seal with quartz, the lead needs a low thermal expansion. Molybdenum is the most common lead material, but molybdenum is expensive, so reducing the amount used is a cost advantage. A common lead seal structure uses a thin molybdenum foil positioned between the internal and external lead wires. The thin foil then seals well to the quartz. Foil seals are expensive to make, and because the foil is flexible, the positioning control of the filament and leads during assembly may be difficult. An alternative seal uses round molybdenum wire that seals to the quartz. The external facing end of the molybdenum wire is butt welded to a steel wire that extends from the envelope for electrical connection.

When a molybdenum and steel lead wire is used in a lamp seal, the steel lead end is not sealed to the envelope material. The steel wire may slip in the surrounding envelope material. Exterior mechanical forces on the steel wire can therefore be transmitted to the weld joint. Also, if the envelope and exposed steel lead are fixed to exterior structures, the expansion and contraction of the steel lead can also exert force on the butt weld. The butt weld can then be mechanically worked by pulling on the leads, for example, by moving the envelope with respect to the base, thereby, or by thermal cycling. Pulling on the leads may cause the butt weld to fail, or the envelope to lead seal to fail. A known solution to the butt weld failure is to formed dents on the steel lead. The dents mechanically lock the steel wire to the glass, or quartz. The dents then prevent the steel lead from slipping in the surrounding glass material, and therefore prevent the steel lead from transferring forces to the butt weld. Unfortunately, the dented steel lead wires are not always successful at preventing the transmission of forces to the butt weld, and lamps made with dented steel leads are known to still fail because of broken butt welds. There is then a need for a lamp seal structure using inexpensive materials, that is easily manufactured, while having a high probability of a long lasting seal.

DISCLOSURE OF THE INVENTION

The Applicants have discovered that lead swagings aligned in the pressing direction are significantly more effective than when oriented at right angles to the pressing direction. The invention is then embodied in an electric lamp having a light source enclosed in an envelope formed from a light transmissive material, and having a press seal formed therein by press jaws closing on the material along pressing axis, two or more leads for powering the light source, wherein at least one of the leads has an internal portion sealed to the envelope material, and an outer portion with a lead axis, and surface variations transverse to the lead axis. The surface variations are positioned within the press seal of the envelope, and distributed around the outer portion of the lead with sufficient frequency to orient at least one of the surface variations approximately parallel to the pressing axis whereby the oriented surface variation is abutted to the envelope along the pressing axis with maximal force during press sealing.

BEST MODE FOR CARRYING OUT THE INVENTION

Figure 1:
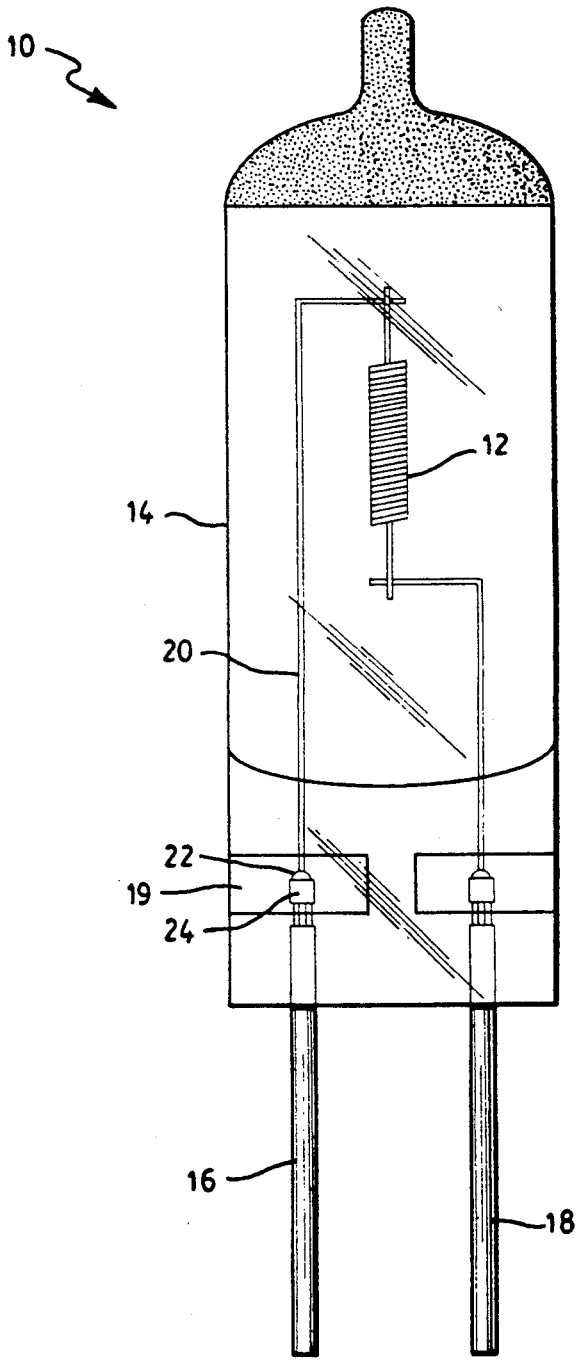
FIG. 1 shows a preferred embodiment of a lamp with double swaged lead.

FIG. 1 shows a preferred embodiment of a lamp with double swaged lead. The lamp 10 with double swaged lead is assembled from a light source 12, an envelope 14, and leads 16, 18 providing electrical connection for the light source 12. An appropriate base (not shown) may be added to support the envelope 14, enclose the seal region where the leads 16, 18 emerge from the envelope 14 and further position or connected the leads 16, 18 for electrical power connection.

The light source 12 may be an arc discharge, or other light source 12; however the expected use of the present lead structure is for a tungsten halogen, filament lamps appropriately supported in an envelope 14. By way of example lamp 10 is shown with a single ended filament light source 12, but may be a double ended filament lamp, an arc discharge lamp, or lamp with other types of light sources.

When the light source 12 is operated at a low temperature, as is the ordinary filament, a glass envelope 14 is normally used. When the light source 12 is designed for a higher temperature, the envelope 14 is normally made of a aluminasilicate glass, borosilicate glass, or quartz.

The envelope 14 material is then light transmissive, and formable by being heated to a plastic state to be blown, pressed, or molded into a designed shape. In particular, an opening in a tubular envelope blank may be heated to a plastic state, and pressed by metal press faces co-acting along a pressing axis to capture and seal the opening while entraining leads 16, 18. Press seals may be made in numerous fashions, with indentations, protuberances, and other formed aspects that are useful, for example in positioning the lamp 10 in a base (not shown). All press seal designs are felt to be adaptable to the present lead structure design. The preferred press seal includes indentations 19 opposite the inner ends of the outer leads to enhance the pressing of the envelope material into intimate contact with the surface variation regions.

The light source 12 is powered by electricity supplied through envelope 14 by the leads 16, 18. At least the first lead 16 includes an inner lead end 20 joined by a butt weld 22 to an outer lead end 24. The inner lead end 20 is formed to have a first material portion that is chosen to seal with the material of the envelope 14. The preferred envelope 14 material is aluminasilicate glass, although borosilicate glass or quartz may be used. The preferred inner lead end 20 material is a molybdenum alloy, for example any of the numerous known low expansion formulations. The preferred inner lead end 20 is a round molybdenum wire forming the inner lead end 20. The outer lead end 24 is chosen to be weldable to the inner lead end 20, electrically conductive, and mechanically tough. The preferred outer lead end 24 material is an iron alloy, for example any one of numerous steels. The preferred outer lead end 24 is a round nickel plated, steel wire that is double swaged to have indented surface variations substantially around the outer lead end 24, or otherwise with sufficient frequency so one or more of the surface variations approximately faces the pressing axis during the press sealing.

To minimize the required press seal length, the preferred surface variations are also located a short distance from the innermost end of the outer lead end 24, where the inner lead end 20 is butt welded 22 to the outer lead end 24. A lead diameter or two from the innermost end of the outer lead end 24 is considered a short distance. The complete first lead 16 is then preferably a round nickel plated, molybdenum wire forming the inner lead end 20 that is butt welded 22 to a round steel wire forming the outer lead end 24. In the preferred embodiment, the second lead 18 is formed in the same fashion as the first lead 16 having an inner portion formed from a round molybdenum wire butt welded to an outer round, nickel plated steel lead. By way of example the leads 16, 18 are shown as cylindrical wires although the leads 16, 18 may be of any other suitable cross sectional configuration.

Figure 2:
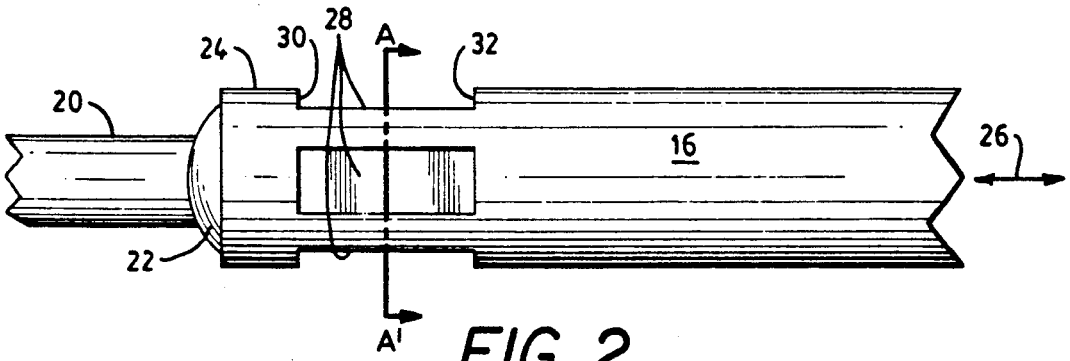
FIG. 2 shows preferred embodiment of the butt weld region of a lamp lead, having ends broken away.
Figure 3:
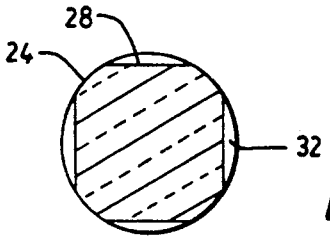
FIG. 3 shows cross sectional view at A—A' of the lamp lead of FIG. 2.

FIG. 2 shows preferred embodiment of the first lead 16 butt weld 22 region with the adjacent inner lead end 20 and outer lead end 24 broken away. FIG. 3 shows cross sectional view at A—A' of the lamp lead of FIG. 2. The inner lead end 20 generally has the form of a cylinder, and is approximately coaxially aligned with outer lead end 24 that also has the general form of a cylinder. The inner lead end 20 is butt welded 22 to the outer lead end 24 to form a weld joint.

The outer lead end 24 generally has a cylindrical form with an axis 26, but is further formed to include surface variations 28. The outer lead end 24 then has an axis 26 extending through the middle of the outer lead end 24 in the long dimension of the outer lead end 24. Extending along the surface of the outer lead end 24, parallel with the axis 26, but projecting, either as an indentation, or a protuberance transverse to the axis 26, are the surface variations 28. A normal to the lead axis 26 through the center of the surface variation 28 is then preferably parallel with the pressing axis. By aligning at least one surface variation 28 with the pressing axis, the full force of the press is used to mate the envelope material with the surface variation. The surface variations 28 are intended to formed barriers that resist axial slipping of the outer lead end 24 when entrained in the envelope 14 material. The surface variations 28 may be protuberances, but are preferably indentations. The surface variations 28 may extend above or below the lead surface from five to twenty-five percent of the lead diameter. Applicants prefer an indentation of about eight to ten percent of the lead diameter. A useful feature for the surface variations 28 is a first face 30 extending substantially transverse to the axis 26, and facing away from the inner lead end 20, towards the outer end of the outer lead end 24. The first face 30 then acts to bluntly block axial motion towards the outer end of the lead. The first face 30 then resists pulling or tugging on the outer lead end 24. A similarly useful feature is a second face 32 extending substantially transverse to the axis 26, and facing towards the inner end of the outer lead end 24. The second face 32 then acts to bluntly block axial motion of the outer lead end 24 towards the innermost end of the outer lead end 24.

The preferred surface variation 28 is a swaging made with a sharp edged tool. By hammering the outer lead end 24 with a sharp edged tool, an indentation is formed that has a first face 30 approximately perpendicular to the lead axis 26, and facing the outer end of the lead. On the opposite side of the indentation is a similar second face 32 extending approximately perpendicular to the lead axis 26, and facing the inner end of the outer lead end 24.

Figure 4:
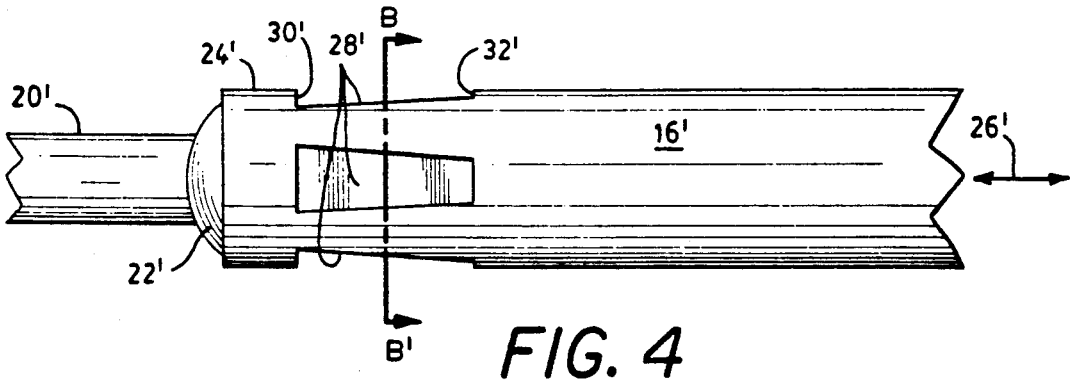
FIG. 4 shows preferred alternative embodiment of the butt weld region of a lamp lead, having ends broken away.
Figure 5:
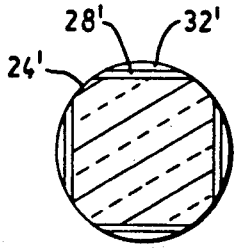
FIG. 5 shows cross sectional view at B—B' of the lamp lead of FIG. 4.

FIG. 4 shows preferred alternative embodiment of the butt weld region of a lamp lead, having ends broken away. FIG. 5 shows cross sectional view at B—B' of the lamp lead of FIG. 4. The swaging need not cause a surface that extends parallel with the outer lead end 24' axis 26'. The surface in one alternative shown in FIGS 4 and 5 is sloped towards the inner lead end 22', enhancing the height of the first face 30'.

An important aspect of the present design is that at least one of the surface variations 28 be oriented in the press seal to extend substantially in the direction of the pressing motion. With the surface variation 28 in the proper orientation, the pressing process forces the envelope 14 material into intimate contact with the surface variation 28. There is then little or no possibility for the pressed mating of at least one of the surface variations to include an intermediate, or adjacent cavity that may weaken the blocking affect of the surface variation 28.

Figure 6:
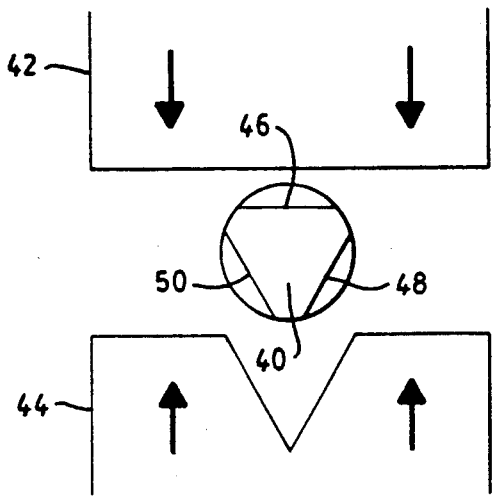
FIG. 6 shows a cross sectional view of a lamp lead being swaged with triangularly arranged indentations.
Figure 7:
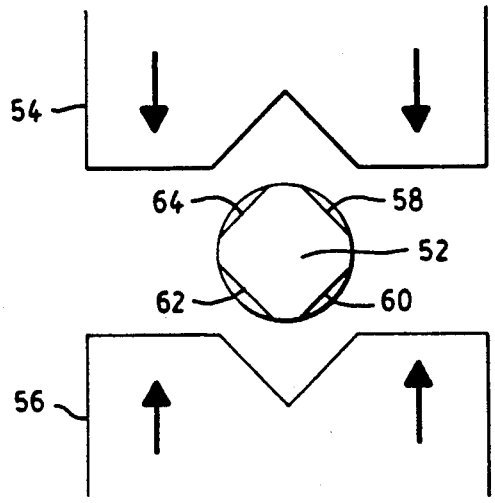
FIG. 7 shows a cross sectional view of a lamp lead being swaged with rectangularly arranged indentations.
Figure 8:
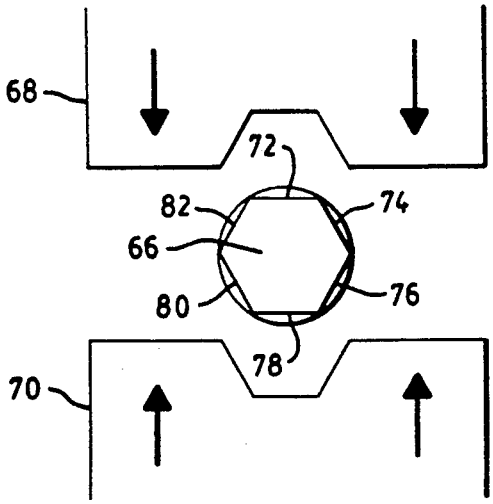
FIG. 8 shows a cross sectional view of a lamp lead being swaged with hexagonally arranged indentations.
Figure 9:
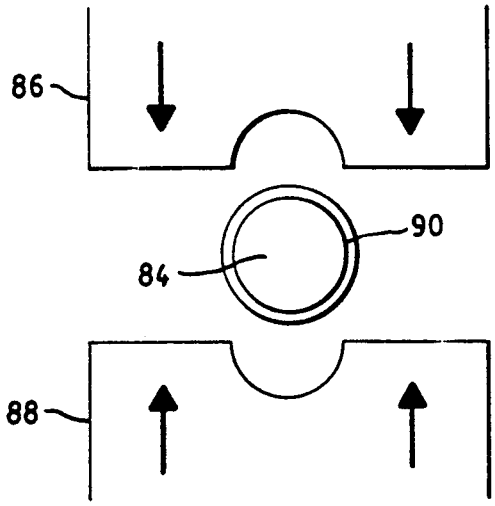
FIG. 9 shows a cross sectional view of a lamp lead being swaged with circularly arranged neck indentation.

The preferred method to achieve proper orientation is to form the surface variations 28 around the outer lead end 24, so that no matter how the lead 16 is oriented, one or more of the surface variations 28 is in approximately aligned with the pressing axis. The swage tools may be formed to hammer a multiplicity of swaged indentations around the outer lead end 24 axis 26. The indentations are then arranged circumferentially around the outer lead end 24. FIG. 6 shows an outer lead end 40 captured at the moment of swaging between a first 42 and second 44 swage tools designed to form three indentations 46, 48, 50 around the outer lead end 40. The three indentations are arranged to approximately parallel the sides of an equilateral triangle. FIG. 7 shows an outer lead end 52 captured at the moment of swaging between a first 54 and second 56 swage tools designed to form four indentations 58, 60, 62, 64 around the outer lead end 52. The four indentations are arranged to approximately parallel the sides of a square. FIG. 8 shows an outer lead end 66 captured at the moment of swaging between a first 68 and second 70 swage tools designed to form six indentations 72, 74, 76, 78, 80, 82 around the outer lead end 66. The six indentations are arranged to approximately parallel the sides of a hexagon. Any polygonal arrangement of the indentations is felt to be possible; however, forming indentations with normals progressively more transverse to the pressing axis becomes increasingly difficult. FIG. 9 shows an outer lead end 84 captured at the moment of swaging between a first 86 and second 88 swage tools designed to form a circular necking 90 around the outer lead end 84.

In a working example some of the dimensions were approximately as follows. The inner lead was a round molybdenum wire with a diameter of 0.406 millimeter (0.016 inch). The outer lead was a round steel wire with a diameter of 1.016 millimeter (0.04 inch). The outer lead was swaged to form four indentations around the lead axis, at about ninety degrees intervals. The indentations extended about 0.088 millimeter (0.0035 inch) into the lead, or about 8.6 percent of the lead diameter. Two faces were formed at opposite ends of the indentation that extended approximately perpendicularly to the lead axis. The faces were separated by about 1.27 millimeter (0.05 inch) with the inner end face located about 0.635 millimeter (0.025 inch) from the weld joint between the outer end of the inner lead and the inner end of the outer lead. The outer face was located about 1.90 millimeter (0.075 inch) from the weld joint. The faces had equal heights, so the face of the indentation was parallel with lead axis. In a proposed alternative structure, the indentations were designed to extend about 0.088 millimeter (0.0035 inch) into the lead on the side nearest the weld joint, but only 0.0508 millimeter (0.002 inch) on the side farthest from the weld joint. The face of the indentation would then be sloped with respect to the lead axis. No matter how the lead was oriented in the press seal, the indentations were no worse than forty-five degrees away from being perpendicular to the pressing motion.

In a test sample of single swaged leads, 82 percent of the lead weld failures had swages oriented 90 degrees to the press direction, while only six percent of failures had orientations parallel with the press direction. The single swage leads when pulled in a direction away from the press seal, had an average breaking point of 34.5 pounds. The double swaged leads had a breaking point average of 43.9 pounds, or about a twenty-seven percent increase in pull strength. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A lamp with a swaged lead comprising:

a) an envelope having a light transmissive material, having an internal wall defining an enclosed internal volume, and a press seal, b) a light source enclosed in the internal volume of the envelope, and c) a first lead and a second lead each extending through the envelope for electrical connection with the light source, wherein at least the first lead includes i) an inner lead end formed of a first material and sealed to the envelope, in the press seal, and ii) an outer lead end formed of a second material, welded to the inner lead end, having an axis, and at least one surface variation extending transverse to the axis, substantially aligned with respect to the pressing direction, and captured in the press seal.

2. The apparatus in claim 1, wherein the light source is a filament.

3. The apparatus in claim 1, wherein the envelope is an aluminasilicate glass.

4. The apparatus in claim 1, wherein the press seal includes an indentation opposite the surface variation.

5. The apparatus in claim 1, wherein the first material is a molybdenum alloy.

6. The apparatus in claim 1, wherein the second material is an iron alloy.

7. The apparatus in claim 1, wherein the surface variation is a swaged indentation.

8. The apparatus in claim 7, wherein the swaged indentation includes an inner face extending substantially transverse to the lead axis, and substantially facing the inner lead.

9. The apparatus in claim 7, wherein the swaged indentation includes an outer face extending substantially transverse to the lead axis, and substantially facing away from the inner lead.

10. The apparatus in claim 7, wherein the inner face extending substantially transverse to the lead axis extends for more than eight percent of the lead diameter.

11. The apparatus in claim 7, wherein a plurality of swaged indentations are arranged around the lead axis in a polygonal pattern.

12. The apparatus in claim 11, wherein the polygonal pattern is a triangle.

13. The apparatus in claim 11, wherein the polygonal pattern is a square.

14. The apparatus in claim 11, wherein the polygonal pattern is a hexagon.

15. The apparatus in claim 11, wherein the swaged indentations form a necked region around the lead axis.

16. A lamp with a swaged lead comprising:

a) an envelope having a light transmissive material, having an internal wall defining an enclosed internal volume, and a press seal, b) a light source enclosed in the internal volume of the envelope, and c) a first lead and a second lead extend through the envelope for electrical connection of the light source, wherein at least the first lead includes i) an inner lead end formed of a first material and sealed to the envelope, in the press seal, and ii) an outer lead end formed of a second material, welded to the inner lead end, having an axis, and more than three swaged indentations extending transverse to the axis, distributed around the lead axis at regular intervals of not more than ninety degrees cause at least one of the indentations to be substantially aligned with respect to the pressing direction, and captured in the press seal.

* * * * *